US007264514B2

(12) United States Patent
Hsu et al.

(10) Patent No.: US 7,264,514 B2
(45) Date of Patent: Sep. 4, 2007

(54) ROTARY SOCKET ASSEMBLY

(75) Inventors: Jung-Hui Hsu, Jhonghe (TW); Jia-Cheng Wei, Jhonghe (TW)

(73) Assignee: Powertech Industrial Co., Ltd., Taipei (TW)

( * ) Notice: Subject to any disclaimer, the term of this patent is extended or adjusted under 35 U.S.C. 154(b) by 0 days.

(21) Appl. No.: 11/256,084

(22) Filed: Oct. 24, 2005

(65) Prior Publication Data

US 2006/0094300 A1 May 4, 2006

(30) Foreign Application Priority Data

Nov. 4, 2004 (TW) ..... 93217655 U

(51) Int. Cl.
*H01R 25/00* (2006.01)

(52) U.S. Cl. ..... 439/640; 439/652; 439/173

(58) Field of Classification Search ..... 439/652, 439/640, 173
See application file for complete search history.

(56) References Cited

U.S. PATENT DOCUMENTS 2,652,546 A * 9/1953 Christner ..... 439/8
6,780,038 B1 * 8/2004 Huang ..... 439/640

* cited by examiner

*Primary Examiner*—Tho D. Ta
(74) *Attorney, Agent, or Firm*—Troxell Law Office, PLLC

(57) ABSTRACT

The present invention relates to a rotary socket assembly comprising an upper casing having at least a set of insert slots at its top surface and a dummy cover on both sides; a terminal set having a terminal pillar for connecting the terminals, a circuit and a terminal plate extended from each corresponding terminal, and the terminal plate is pivotally coupled with the terminal; a terminal seat having a component for connecting each set of terminals, the upper casing and an external housing; a lower casing, being an arc plate for connecting each terminal seat with each terminal set. After the upper and lower casings are engaged, the insert slots can be rotated for adjusting the inserting direction.

7 Claims, 4 Drawing Sheets

ROTARY SOCKET ASSEMBLY

BACKGROUND OF THE INVENTION

1. Field of the Invention

The present invention relates to a rotary socket assembly, and more particularly to a socket assembly having at least one socket and each socket can be turned selectively within the range of 180 degrees.

2. Description of the Related Art

For years, sockets have been used for obtaining electric power, and a socket is used to obtain power for electric appliances regardless of its being used indoors or outdoors. Since more and more electric appliances are developed and introduced, therefore the number of required sockets has increased, and an extension cord is needed for supplying electric power to these electric appliances.

In general, the sockets of a prior art extension cord are fixed. In other words, the two-slot or three-slot extension cord is generally fixed and aligned linearly, so that a cable can be inserted into the slot in a fixed direction only. Even a three-dimensional socket allows a fixed inserting direction only.

Since the disposing and installing positions of an electric appliance product for obtaining electric power vary, the direction for inserting a cable usually does not linearly align with the direction of the socket, after the cable is inserted into the socket. For example, the insertion of a cable will be very difficult if the inserting direction of a cable is perpendicular to the inserting direction of the socket. In other words, the cable of the inserted connector has to be twisted for the installation.

SUMMARY OF THE INVENTION

In view of the shortcomings of the prior art, the inventor of the present invention based on years of experience in the related industry to perform extensive researches and experiments, and finally invented a rotary socket assembly in accordance with the present invention.

Refer to the figures for the detailed disclosure of the technical characteristics of the present invention, wherein FIG. 1 shows an exploded view of a preferred embodiment of the present invention, FIG. 2 shows an exploded view of a unit of a preferred embodiment of the invention, FIG. 3 shows an exploded view of an accessory unit of a preferred embodiment of the invention, and FIG. 4 shows a perspective view of a preferred embodiment of the present invention.

DETAILED DESCRIPTION OF THE PREFERRED EMBODIMENTS

Figure 1:
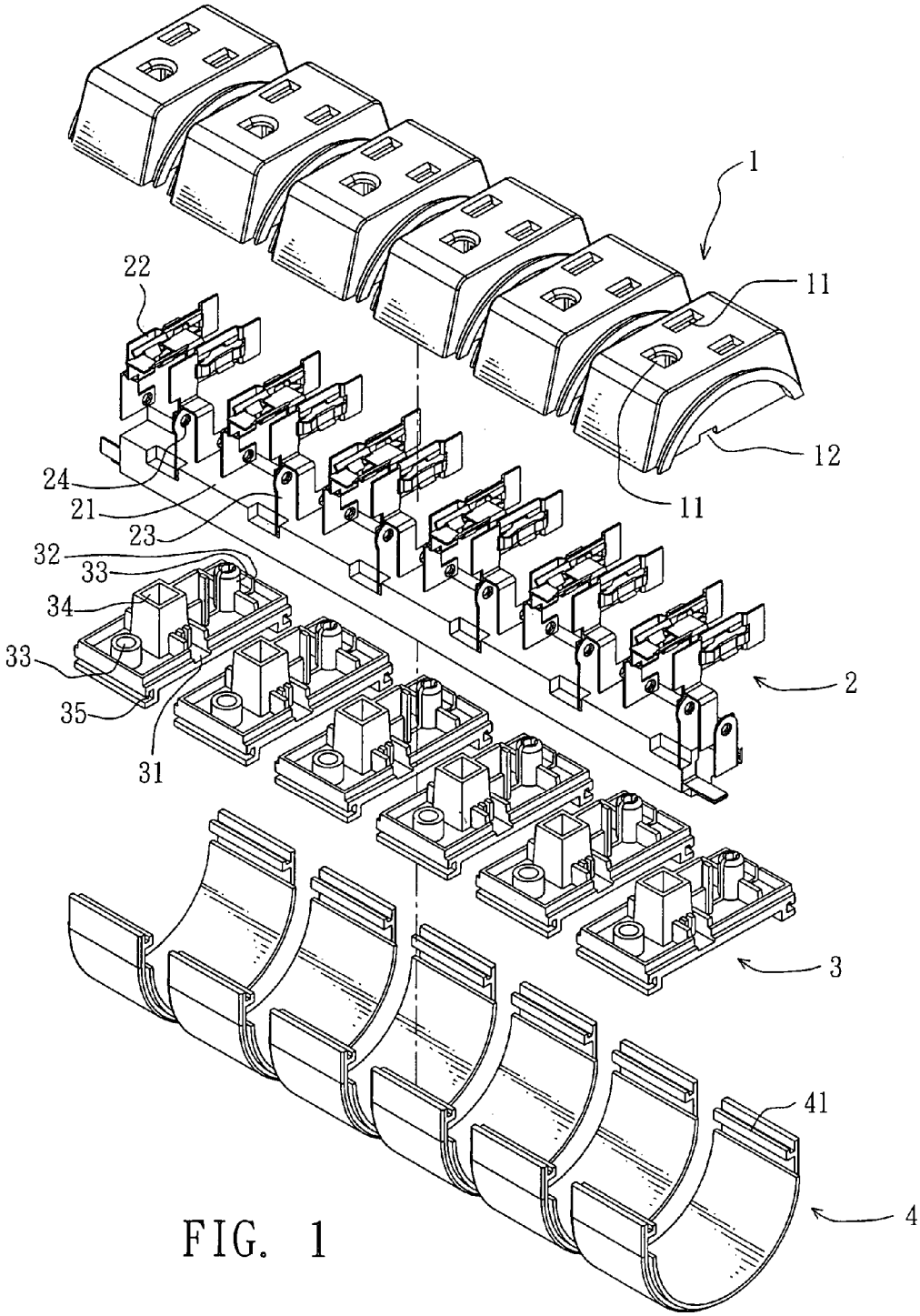
FIG. 1 is an exploded view of a preferred embodiment of the present invention.

Referring to the figures for the present invention, a rotary socket assembly of the present invention comprises an upper casing 1, a terminal set 2, a terminal seat 3, a lower casing 4, and/or a base 5, a lid 6, and a wire clamp 7.

The upper casing 1 is a cover made of an insulating material and having an insert slot 11 at its top surface, and the insert slot 11 is a two-hole slot if it is for two electrodes, and this embodiment adopts a three-hole slot, and a dummy cover 12 is installed separately on both sides for electrically connect the electrode plate of the terminal set 2, and a component is disposed at the internal side of the upper wall for fixing the electrode plate, and the component could be an embedded groove (which is not shown in the figure due to the projection angle) integrally formed by an injection molding method. However, it is a prior art, and thus will not be described here. To connect the embedded groove with the corresponding terminal seat 3, a tenon or hole is provided. However, it is a prior art, and thus will not be described here. The number of the upper casings 1 is corresponsive with the number of terminal sets 2.

Figure 2:
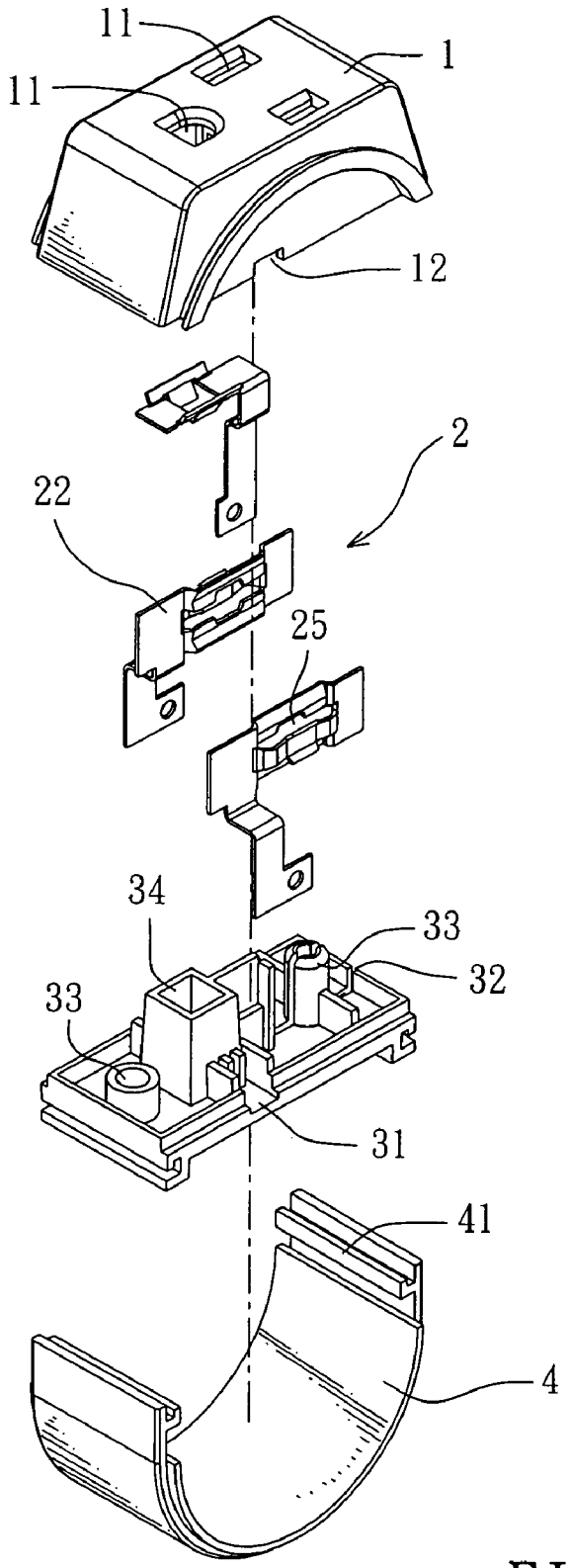
FIG. 2 is an exploded view of a unit of a preferred embodiment of the present invention.

The terminal set 2 comprises a long bar-shaped terminal pillar 21 disposed at the bottom of the terminal set 2 for physically and electrically connecting each terminal 22, such that the terminal pillar 21 has the same number of electrodes as the foregoing insert hole 11 such as the holes for a fire line, a neutral line and/or a ground electrode. Each terminal pillar 21 includes a terminal plate 23 disposed on the terminal pillar 21 for pivotally connecting with the terminal 22. In other words, each terminal 22 uses a rivet pivotal axis 24 to form a turn of each terminal 22 with respect to the terminal plate 23, and each set of terminals 22 corresponds to the foregoing upper casing 1. Therefore, the terminal plate 23 can be designed as an insert crevice 25 (as shown in FIG. 2). If it is for a ground terminal, then it could be a square frame. However, it is a prior art, and thus will not be described here.

The terminal seat 3 is a seat base for accommodating each set of terminals 22, and thus is integrally made of an insulating material to form a recession 31 at the turning position of the terminal 22 and a seat creavice 32 for clamping the ground terminal. Further, a connecting means 33 and a protruded frame fence 34 corresponsive to the grounding insert hole 11 of the upper casing 1 can be connected to the upper casing 1, but these are prior arts and thus will not be described here. An embedded groove 35 is disposed on both external sides of the bottom of the terminal seat 3 for connecting the lower casing 4.

The lower casing 4 is an arc plate object and the number of the arc plate objects is corresponsive to the upper casing, and a corresponding embedded tenon 41 is disposed at the top for connecting the foregoing embedded groove 35.

Figure 3:
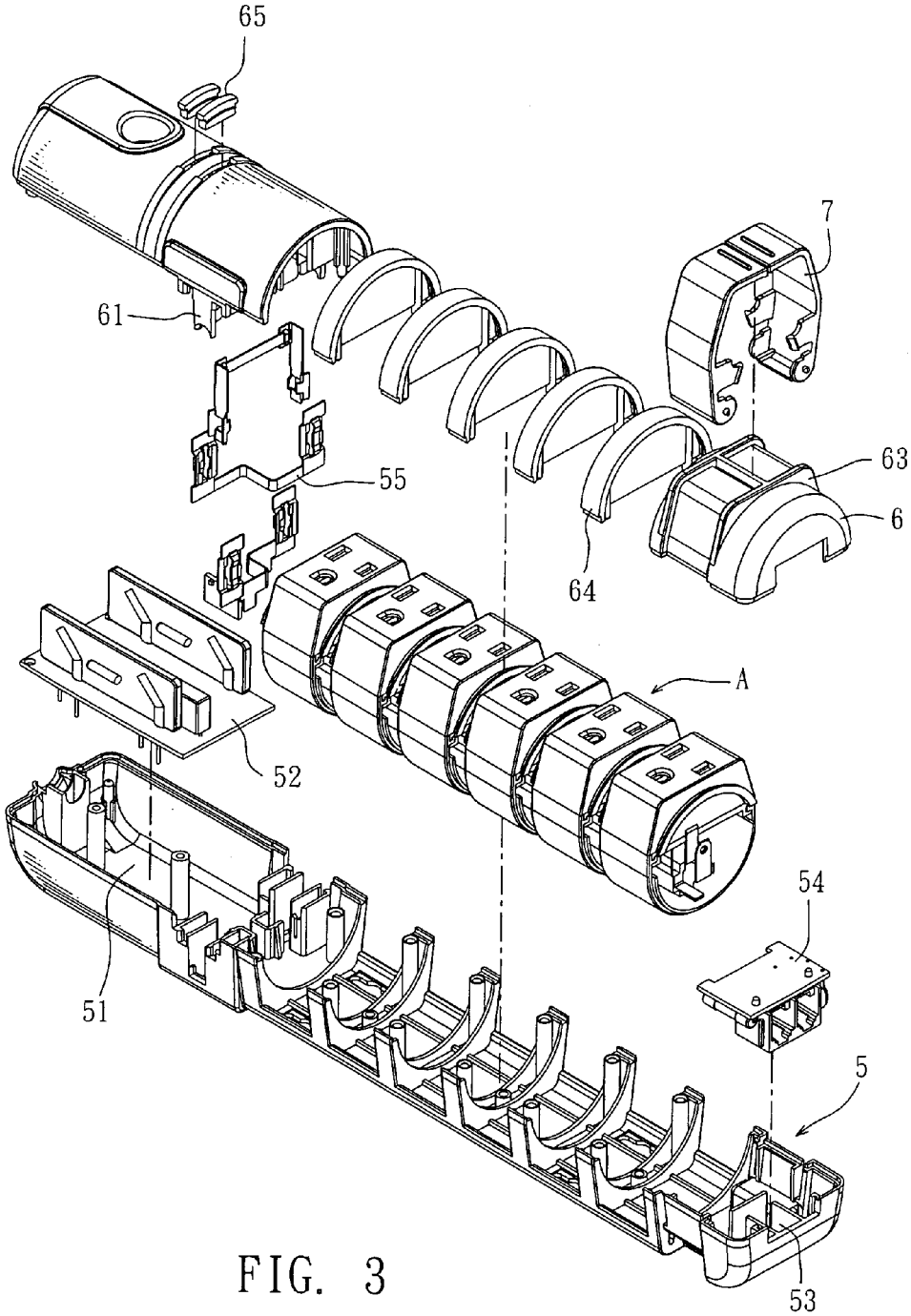
FIG. 3 is an exploded view of an accessory component of a preferred embodiment of the present invention.

Referring to the figures for the assembling of the present invention, the terminal set 2 and the terminal seat 3 are connected, and the lower casing 4 is connected to the terminal seat 3, and the upper casing 1 is connected to each terminal 22 to form a rotary socket module A as shown in FIG. 3. After an end of the terminal set 2 is electrically connected, then each component can be rotated axially with respect to the frame axis 24 to fit the requirements for different inserting directions.

Figure 4:
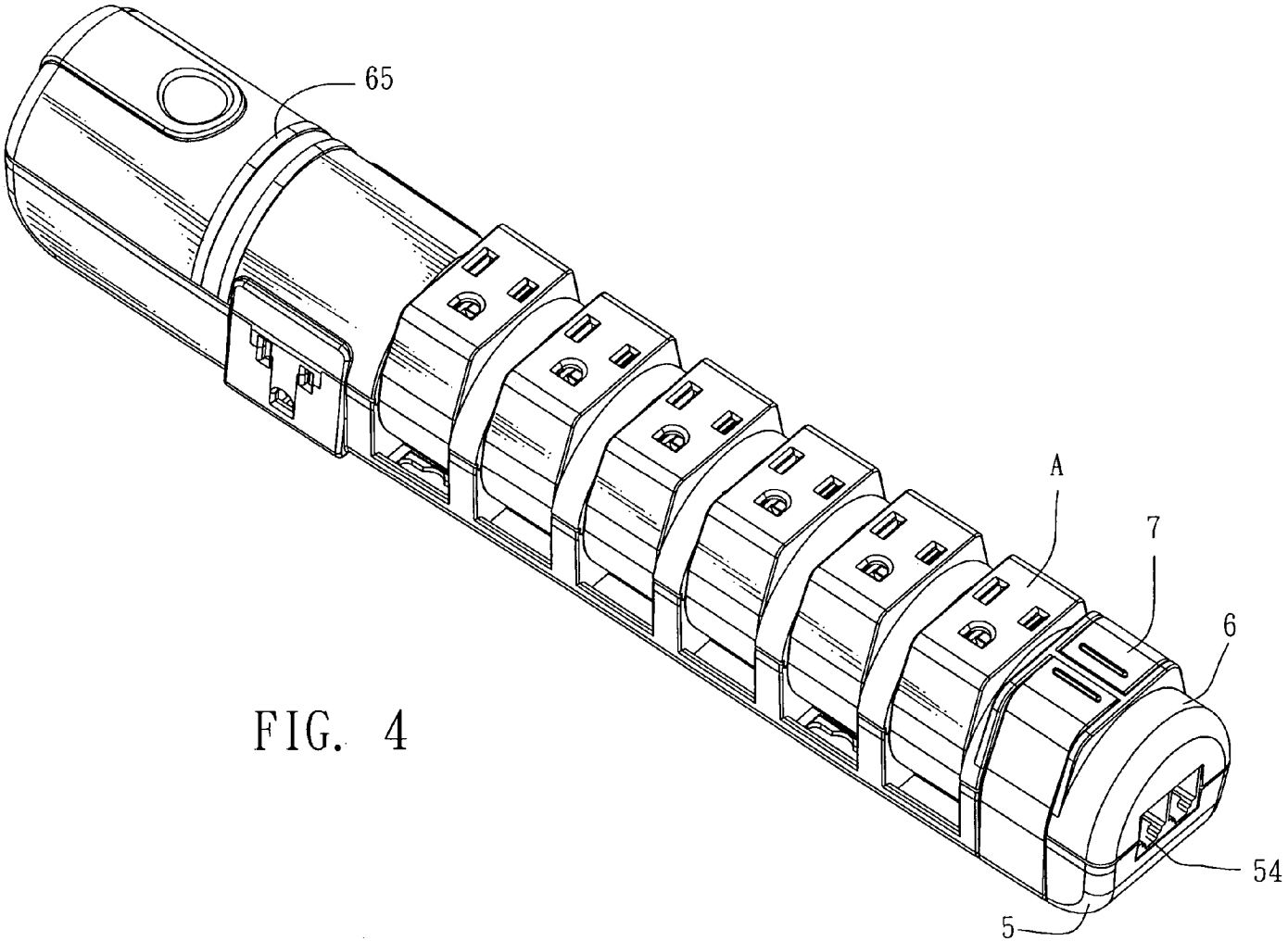
FIG. 4 is a perspective view of a preferred embodiment of the present invention.

Referring to FIG. 4, the rotary socket assembly of the present invention further comprises related accessory components such as a base 5, a lid 6, and a wire clamp 7.

The base 5 is provided for accommodating the foregoing rotary socket module A, and an end of the base 5 includes a chamber 51 for containing a surge wave component 52, and the other end of the base includes a rear chamber 53 for installing a telephone connector 54. Further, the surge wave component 52 adds a sets of terminals 55, and the lid 6 includes an embedded member 61 corresponding to the base 5 for containing the terminals 55, and an insert hole 62 for inserting the connector (not shown in the figure due to the projection angle). In the meantime, a rear cover 63 corresponding to the rear chamber 53 is provided as a cover. To partition each set of terminals, an embedded ring 64 can be installed for connecting the rotary socket module A, and a display device 6 can be added. However, these are prior arts, and thus will not be described here.

The wire clamp 7 is provided for clamping and managing the cables after the connectors are inserted, and thus the wire clamp 7 is a clamp with an open section.

Referring to the figures, the present invention is assembled as shown in FIG. 4, and each terminal can be turned 180 degrees individually, and thus it can meet the requirements for different inserting directions.

With the implementation of the present invention, the rotary socket assembly is in a long bar shape. In addition to its simple stylish design, the rotary socket assembly does not occupy much space, and each terminal set can be rotated individually to faciliate external connections, and thus the present invention is a breakthrough of the rotary sockets.

While the invention has been described by means of specific embodiments, numerous modifications and variations could be made thereto by those skilled in the art without departing from the scope and spirit of the invention set forth in the claims. In summation of the above description, the present invention herein enhances the performance than the conventional structure and further complies with the patent application requirements and is submitted to the Patent and Trademark Office for review and granting of the commensurate patent rights.

What is claimed is:

1. A rotary socket assembly, comprising:

an upper casing, having at least one insert hole disposed at the top surface of said upper casing, and a dummy cover disposed on both sides of said upper casing;

a terminal pillar for connecting a plurality of terminals, a circuit, and a terminal plate extended from said terminal pillar and pivotally coupled to said each terminal;

a terminal seat, having a component for connecting said each terminal with said upper casing and a lower casing; and said lower casing, being an arc sheet object; thereby said each terminal seat is separately coupled to a set of said plurality of terminals, upper casing, and lower casing and separately rotated for adjusting an inserting direction.

2. The rotary socket assembly of claim 1, wherein said upper casing includes three insert holes.

3. The rotary socket assembly of claim 1, wherein said terminal seat is coupled with said lower casing by a tenon and a groove.

4. The rotary socket assembly of claim 1, further comprising a base for accommodating said rotary socket assembly, a chamber disposed at an end of said base for accommodating a surge wave component, a lid for covering said chamber, and a terminal plate disposed between said two upper casings.

5. The rotary socket assembly of claim 1, further comprising a telephone connector installed at a rear chamber of said base, and a rear cover corresponsive to said lid.

6. The rotary socket assembly of claim 1, further comprising a wire clamp clamped at said lid and the rear end of said base.

7. The rotary socket assembly of claim 1, wherein said terminal seat is connected by wires to achieve the effect of being rotated separately for adjusting the inserting direction.

* * * * *